US009858864B2

(12) United States Patent
Takahiro

(10) Patent No.: US 9,858,864 B2
(45) Date of Patent: Jan. 2, 2018

(54) PIXEL CIRCUIT AND DISPLAY DEVICE INCLUDING THE SAME

(71) Applicant: Samsung Display Co., Ltd., Yongin, Gyeonggi-Do (KR)

(72) Inventor: Senda Takahiro, Hwaseong-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 46 days.

(21) Appl. No.: 14/815,834

(22) Filed: Jul. 31, 2015

(65) Prior Publication Data

US 2016/0240132 A1 Aug. 18, 2016

(30) Foreign Application Priority Data

Feb. 13, 2015 (KR) ..... 10-2015-0022171

(51) Int. Cl.
*G09G 3/32* (2016.01)
*G09G 3/3291* (2016.01)
(Continued)

(52) U.S. Cl.
CPC ..... *G09G 3/3291* (2013.01); *G09G 3/325* (2013.01); *G09G 3/3233* (2013.01); *G09G 2300/0426* (2013.01); *G09G 2300/0814* (2013.01); *G09G 2300/0819* (2013.01); *G09G 2300/0842* (2013.01); *G09G 2300/0861* (2013.01);
(Continued)

(58) Field of Classification Search
CPC ..... G09G 2310/08; G09G 2300/0426; G09G 2330/021; G09G 3/3233; G09G 3/3258; G09G 3/3696; G09G 2310/0286; G09G 3/20
See application file for complete search history.

(56) References Cited

U.S. PATENT DOCUMENTS

2006/0107146 A1* 5/2006 Kim ..... G09G 3/3233 714/727
2007/0001945 A1* 1/2007 Yoshida ..... G09G 3/3233 345/87
2011/0141084 A1* 6/2011 Kishi ..... G09G 3/2003 345/211
2013/0127692 A1* 5/2013 Yoon ..... G09G 3/3258 345/80

FOREIGN PATENT DOCUMENTS

JP 2003-323159 11/2003
KR 10-2013-0055402 A 5/2013
(Continued)

*Primary Examiner* — Olga Merkoulova
(74) *Attorney, Agent, or Firm* — Knobbe Martens Olson & Bear, LLP

(57) ABSTRACT

A pixel circuit and a display device including the pixel circuit are disclosed. In one aspect, the pixel circuit includes an organic light-emitting diode (OLED) including a first terminal electrically connected to a first node and a second terminal electrically connected to a ground voltage. The circuit also includes a driver including a driving transistor including gate, drain and source terminals, and a first capacitor configured to be charged based on a scan signal and a data signal. The first capacitor includes a first terminal electrically connected to the gate terminal of the driving transistor via a second node. The first capacitor also includes a second terminal electrically connected to a supply voltage. The drain terminal of the driving transistor is electrically connected to the supply voltage, and the source terminal of the driving transistor is electrically connected to the first node.

20 Claims, 9 Drawing Sheets

(51) Int. Cl.
*G09G 3/325* (2016.01)
*G09G 3/3233* (2016.01)

(52) U.S. Cl.
CPC ..... *G09G 2310/0248* (2013.01); *G09G 2310/0251* (2013.01); *G09G 2320/0233* (2013.01); *G09G 2320/0295* (2013.01); *G09G 2320/045* (2013.01)

(56) References Cited

FOREIGN PATENT DOCUMENTS

KR 10-2014-0080728 A 7/2014
KR 10-2014-0081450 A 7/2014

* cited by examiner

PIXEL CIRCUIT AND DISPLAY DEVICE INCLUDING THE SAME

CROSS-REFERENCE TO RELATED APPLICATION(S)

This application claims priority under 35 USC §119 to Korean Patent Applications No. 10-2015-0022171, filed on Feb. 13, 2015 in the Korean Intellectual Property Office (KIPO), the contents of which are incorporated herein in its entirety by reference.

BACKGROUND

Field

The described technology generally relates to a pixel circuit and a display device including the pixel circuit.

Description of the Related Technology

Unlike liquid crystal displays, organic light-emitting diode (OLED) displays generate an image without a light source (e.g., backlight unit). Thus, an OLED display can be made relatively thin and light. In addition, OLED technology has favorable characteristics such as low power consumption, improved luminance, improved response speed, etc. compared to LCDs. Hence, more electronic devices are adopting OLED displays as the display of choice.

In general, like many electrical elements, OLEDs have parasitic capacitance. Due to this, the ability to express luminance gradation on the OLED display can degrade because the OLED transitions from activation to deactivation.

SUMMARY OF CERTAIN INVENTIVE ASPECTS

One inventive aspect relates to a pixel circuit which enhances a gradation expression ability by automatically discharging electric charges of the OLED when input of the OLED transfers from the activation level to the deactivation level in normal mode, and reduces effect of leakage current during measurement of the OLED's characteristic in test mode.

Another aspect is an OLED display including a pixel circuit which enhances a gradation expression ability by automatically discharging electric charges of the OLED when input of the OLED transfers from the activation level to the deactivation level in normal mode, and reduces effect of leakage current during measurement of the OLED's characteristic in test mode.

Another aspect is a pixel circuit that includes an OLED, a driver, an initialization controller, and an initializer. The OLED has a terminal connected to a first node and the other terminal receiving a ground voltage. The driver includes a driving transistor and a first capacitor charged in response to a scan signal and a data signal. A terminal of the first capacitor is connected to a gate terminal of the driving transistor through a second node. The other terminal of the first capacitor receives a supply voltage. A drain terminal of the driving transistor receives the supply voltage. A source terminal of the driving transistor is connected to the first node. The initialization controller drives a third node as the supply voltage during a first period in which a voltage of the second node becomes the ground voltage. The initialization controller drives the third node as a sensing signal during a second period in which the voltage of the second node becomes the supply voltage. The initializer drives the first node as a first voltage when a voltage of the third node is the ground voltage.

In an example embodiment, if the pixel circuit operates in a normal mode, the sensing signal is activated during a first initialization period included in the first period. The sensing signal can be deactivated during a first driving period which exists after the first initialization period and is included in the first period, the sensing signal can be activated during a second initialization period included in the second period, the sensing signal can be deactivated during a second driving period which exists after the second initialization period and is included in the second period, the data signal can be provided through a first signal line, and an initialization voltage generator can provide the ground voltage to the initializer as the first voltage through a second line.

In an example embodiment, if the pixel circuit operates in the normal mode, the first period is included in first sub frame periods in which the OLED emits light among a plurality of sub frame periods assigned to the pixel circuit. The second period can be included in second sub frame periods in which the OLED does not emit light among the plurality of the sub frame periods assigned to the pixel circuit.

In an example embodiment, the first period starts after a third period in which the ground voltage is provided as the data signal, the ground voltage is provided as the scan signal, and the first capacitor is charged.

In an example embodiment, the driving transistor is turned on and the OLED emits light during the first period.

In an example embodiment, the second period starts after a fourth period in which the supply voltage is provided as the data signal, the ground voltage is provided as the scan signal, and the first capacitor is discharged.

In an example embodiment, in the second initialization period, electric charges of a parasitic capacitor of the OLED is discharged, the driving transistor is turned off, and the OLED does not emit light.

In an example embodiment, if the pixel circuit operates in a test mode, the ground voltage is provided as the scan signal, and the data signal having the supply voltage is provided through a first signal line. If the pixel circuit operates in the test mode, during the second period, the sensing signal can be activated, a tester can provide a test voltage as the first voltage through a second signal line, and the tester can measure characteristic of the OLED based on a test current flowing from the tester to the initializer In an example embodiment, if the pixel circuit operates in a normal mode, the sensing signal is activated during a first initialization period included in the first period. The sensing signal can be deactivated during a first driving period which exists after the first initialization period and is included in the first period, the sensing signal can be activated during a second initialization period included in the second period, the sensing signal can be deactivated during a second driving period which exists after the second initialization period and is included in the second period, a initialization voltage generator can provide the ground voltage as the first voltage through a first signal line during the first and second initialization periods, and the data signal can be provided to the first signal line during other period than the first and second initialization periods.

In an example embodiment, if the pixel circuit operates in a test mode, the ground voltage is provided as the scan signal. If the pixel circuit operates in the test mode, during the second period, the sensing signal can be activated, a tester can provide a test voltage as the first voltage through a first signal line, and the tester can measure characteristic of the OLED based on a test current flowing from the tester to the initializer.

In an example embodiment, the driver further includes a scan transistor. A drain terminal of the scan transistor can receive the data signal, a gate terminal of the scan transistor can receive the scan signal, and a source terminal of the scan transistor can be connected to the second node.

In an example embodiment, the initialization controller includes a control transistor and a second capacitor. A drain terminal of the control transistor can receive the supply voltage, a gate terminal of the control transistor can be connected to the second node, and a source terminal of the control transistor can be connected to the third node. A terminal of the second capacitor can receive the sensing signal, and the other terminal of the second capacitor can be connected to the third node.

In an example embodiment, the initializer includes an initialization transistor. A drain terminal of the initialization transistor can be connected to the first node, a gate terminal of the initialization transistor can be connected to the third node, and a source terminal of the initialization transistor can receive the first voltage.

In an example embodiment, the initializer includes a first initialization transistor and a second initialization transistor. A drain terminal of the first initialization transistor can be connected to the first node, a gate terminal of the first initialization transistor can be connected to the third node, and a source terminal of the first initialization transistor can be connected to a drain terminal of the second initialization transistor. A gate terminal of the second initialization transistor can receive the sensing signal, and a source terminal of the second initialization transistor can receive the first voltage.

Another aspect is a display device that includes a timing controller, a display panel, a data driver, and a scan driver. The timing controller generates a data driver control signal and a scan driver control signal based on a pixel data. The display panel includes a plurality of pixel circuits. The data driver generates a plurality of data signals based on the data driver control signal, and provides the data signals to the plurality of the pixel circuits through a plurality of data signal lines. The scan driver generates a plurality of scan signals based on the scan driver control signal, and provides the scan signals to the plurality of the pixel circuits through a plurality of scan signal lines. The first pixel circuit among the plurality of the pixel circuits includes an OLED, a driver, an initialization controller, and an initializer. The OLED has a terminal connected to a first node and the other terminal receiving a ground voltage. The driver includes a driving transistor and a first capacitor charged in response to the first scan signal and the first data signal. A terminal of the first capacitor is connected to a gate terminal of the driving transistor through a second node. The other terminal of the first capacitor receives a supply voltage. A drain terminal of the driving transistor receives the supply voltage. A source terminal of the driving transistor is connected to the first node. The initialization controller drives a third node as the supply voltage during a first period in which a voltage of the second node becomes the ground voltage, and drives the third node as a sensing signal during a second period in which the voltage of the second node becomes the supply voltage. The initializer drives the first node as a first voltage when a voltage of the third node is the ground voltage.

Another aspect is a pixel circuit of an display device, the pixel circuit comprising: an organic light-emitting diode (OLED) including a first terminal electrically connected to a first node and a second terminal electrically connected to a ground voltage; a driver including i) a driving transistor including gate, drain and source terminals and ii) a first capacitor configured to be charged based on a scan signal and a data signal, wherein the first capacitor includes i) a first terminal electrically connected to the gate terminal of the driving transistor via a second node and ii) a second terminal electrically connected to a supply voltage, wherein the drain terminal of the driving transistor is electrically connected to the supply voltage, and wherein the source terminal of the driving transistor is electrically connected to the first node; an initialization controller configured to i) provide the supply voltage to a third node during a first change period in which the initialization controller is further configured to provide the ground voltage to the second node and ii) provide a sensing signal to the third node during a second change period in which the initialization controller is further configured to provide the supply voltage to the second node; and an initializer configured to provide a first voltage to the first node when a voltage of the third node is the ground voltage.

In the above pixel circuit, the first change period includes a first initialization period and a first driving period following the first initialization period, wherein the second change period includes a second initialization period and a second driving period following the second initialization period, wherein the initialization controller is further configured to i) receive the sensing signal having a first voltage level during the first initialization period, ii) receive the sensing signal having a second voltage level during the first driving period, iii) receive the sensing signal having the first voltage level during the second initialization period, and iv) receive the sensing signal having the second voltage level during the second driving period, in response to the pixel circuit operating in a normal mode, wherein the first and second voltage levels are different, wherein the driver is configured to receive the data signal via a first signal line, and wherein the initializer is configured to receive the ground voltage as the first voltage from an initialization voltage generator via a second signal line.

In the above pixel circuit, the OLED is configured to emit light during a plurality of first sub frame periods and not emit light during a plurality of second sub frame periods, wherein each first sub frame period includes the first change period and wherein each second sub frame period includes the second change period.

In the above pixel circuit, the driver is further configured to i) receive the ground voltage as the data signal during a third period preceding the first change period and ii) receive the ground voltage as the scan signal during the third period so as to charge the first capacitor.

In the above pixel circuit, during the first change period, the driving transistor is configured to be turned on and the OLED is configured to emit light.

In the above pixel circuit, the driver is further configured to i) receive the supply voltage as the data signal during a fourth period preceding the second change period and ii) receive the ground voltage as the scan signal during the fourth period so as to discharge the first capacitor.

In the above pixel circuit, in the second initialization period, i) the initializer is further configured to discharge electric charge of a parasitic capacitor of the OLED and ii) the driving transistor is configured to be turned off, such that the OLED does not emit light.

In the above pixel circuit, the driver is configured to i) receive the ground voltage as the scan signal and ii) receive the supply voltage as the data signal via a first signal line, in response to the pixel circuit in a test mode, wherein, during the second change period, the initialization controller is further configured to receive the sensing signal having a first voltage level, wherein the initializer is further configured to receive a test voltage as the first voltage via a second signal line and wherein a characteristic of the OLED is configured to be measured based on the test voltage.

In the above pixel circuit, the characteristic includes at least one of luminance and OLED current.

In the above pixel circuit, the first change period includes a first initialization period and a first driving period following the first initialization period, wherein the second change period includes a second initialization period and a second driving period following the second initialization period, wherein the initialization controller is further configured to i) receive the sensing signal having a first voltage during the first initialization period, ii) receive the sensing signal having a second voltage level during the first driving period, iii) receive the sensing signal having the first voltage level during the second initialization period, and iv) receive the sensing signal having the second voltage during the second driving period, wherein the first and second voltage levels are different, wherein the initializer is further configured receive the ground voltage as the first voltage via a first signal line during the first and second initialization periods, and wherein the driver is configured to receive the data signal via the first signal line during a period other than the first and second initialization periods.

In the above pixel circuit, the driver is configured to receive the ground voltage as the scan signal, in response to the pixel circuit operating in a test mode, wherein, during the second change period, the initialization controller is further configured to receive the sensing signal having the first voltage level, wherein the initializer is further configured to receive a test voltage as the first voltage via a first signal line and wherein a characteristic of the OLED is configured to be measured based on the test voltage.

In the above pixel circuit, the driver further includes a scan transistor including i) a drain terminal configured to receive the data signal from a data line, ii) a gate terminal configured to receive the scan signal from a scan line, and iii) a source terminal electrically connected to the second node.

In the above pixel circuit, the initialization controller includes: a control transistor including a drain terminal electrically connected to the supply voltage, a gate terminal electrically connected to the second node, and a source terminal electrically connected to the third node; and a second capacitor including a first terminal configured to receive the sensing signal from a sensing signal generator and a second terminal electrically connected to the third node.

In the above pixel circuit, the initializer includes an initialization transistor including a drain terminal electrically connected to the first node, a gate terminal electrically connected to the third node, and a source terminal electrically connected to the first voltage.

In the above pixel circuit, the initializer includes: a first initialization transistor including a drain terminal electrically connected to the first node, a gate terminal electrically connected to the third node, and a source terminal; and a second initialization transistor including a gate terminal configured to receive the sensing signal from a sensing signal generator, a source terminal electrically connected to the first voltage, and a drain terminal electrically connected to the source terminal of the first initialization transistor.

Another aspect is a display device comprising: a timing controller configured to generate a data driver control signal and a scan driver control signal based on pixel data; a display panel including a plurality of pixel circuits; a data driver configured to generate a plurality of data signals based on the data driver control signal and provide the data signals to the pixel circuits via a plurality of data signal lines, wherein the data signals include a first data signal; and a scan driver configured to generate a plurality of scan signals based on the scan driver control signal and provide the scan signals to the pixel circuits via a plurality of scan signal lines, wherein the scan signals include a first scan signal. A selected pixel circuit among the pixel circuits includes: an organic light-emitting diode (OLED) including a first terminal electrically connected to a first node and a second terminal electrically connected to a ground voltage; a driver including i) a driving transistor including gate, drain and source terminals and ii) a first capacitor configured to be charged based on the first scan signal and the first data signal, wherein the first capacitor includes i) a first terminal electrically connected to the gate terminal of the driving transistor via a second node and ii) a second terminal electrically connected a supply voltage, wherein the drain terminal of the driving transistor is electrically connected to the supply voltage, and wherein the source terminal of the driving transistor is electrically connected to the first node; an initialization controller configured to i) provide the supply voltage to a third node during a first change period in which the initialization controller is further configured to provide the ground voltage to the second node and ii) provide a sensing signal to the third node during a second change period in which the initialization controller is further configured to provide the supply voltage to the second node; and an initializer configured to provide a first voltage to the first node when a voltage of the third node is the ground voltage.

In the above display device, the first change period includes a first initialization period and a first driving period following the first initialization period, wherein the second change period includes a second initialization period and a second driving period following the second initialization period, wherein the data driver is further configured to generate the first data signal via a first signal line, and wherein the display device further comprises: a sensing signal generator is configured to i) activate the sensing signal during the first initialization period, ii) deactivate the sensing signal during the first driving period, iii) activate the sensing signal during the second initialization period, and iv) deactivate the sensing signal during the second driving period, in response to the pixel circuit operating in a normal mode, and an initialization voltage generator is configured to generate the ground voltage to the initializer as the first voltage via a second signal line.

In the above display device, the OLED is configured to emit light during a plurality of first sub frame periods and not emit light during a plurality of second sub frame periods, wherein each first sub frame period includes the first change period and each second sub frame period includes the second change period.

In the above display device, the data driver is further configured to generate the ground voltage as the first data signal during a third period preceding the first change period, wherein the scan driver is configured to generate the ground voltage as the first scan signal during the third period so as to charge the first capacitor.

In the above display device, the driving transistor is configured to be turned on during the first change period and wherein the OLED is configured to emit light during the first change period.

According to at least one of the disclosed embodiments, the pixel circuit and the display device enhance a gradation expression ability by automatically discharging electric charges of the OLED when input of the OLED transfers from the activation level to the deactivation level in normal mode, and measure the OLED's characteristic accurately by reducing effect of leakage current in test mode.

DETAILED DESCRIPTION OF CERTAIN INVENTIVE EMBODIMENTS

Figure 1:
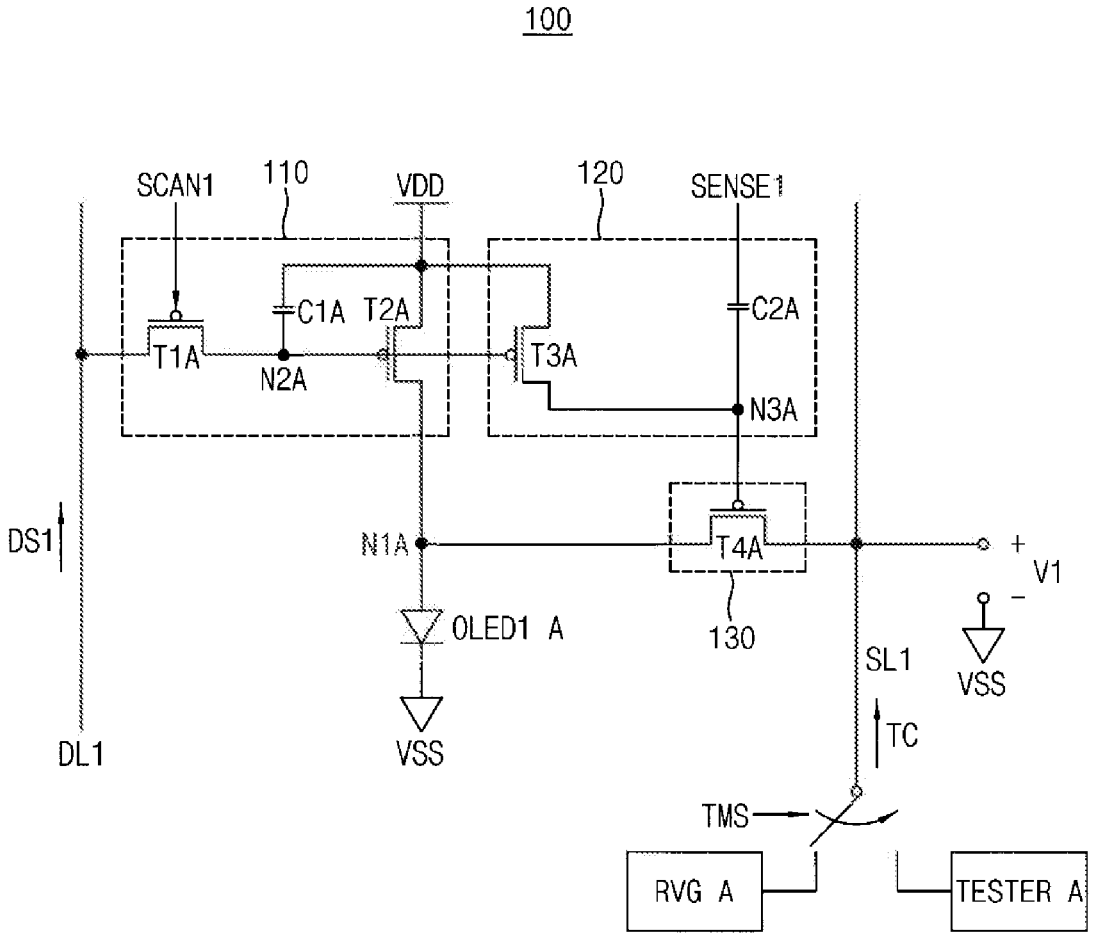
FIG. 1 is a block diagram illustrating a pixel circuit according to an example embodiment.

Various example embodiments will be described more fully hereinafter with reference to the accompanying drawings, in which some example embodiments are shown. The described technology can, however, be embodied in many different forms and should not be construed as limited to the example embodiments set forth herein. Rather, these example embodiments are provided so that this disclosure will be thorough and complete, and will fully convey the scope of the described technology to those skilled in the art. In the drawings, the sizes and relative sizes of layers and regions can be exaggerated for clarity. Like numerals refer to like elements throughout.

It will be understood that, although the terms first, second, third etc. can be used herein to describe various elements, these elements should not be limited by these terms. These terms are used to distinguish one element from another. Thus, a first element discussed below could be termed a second element without departing from the teachings of the described technology. As used herein, the term "and/or" includes any and all combinations of one or more of the associated listed items.

It will be understood that when an element is referred to as being "connected" or "coupled" to another element, it can be directly connected or coupled to the other element or intervening elements can be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular example embodiments only and is not intended to be limiting of the described technology. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this described technology belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein. In this disclosure, the term "substantially" includes the meanings of completely, almost completely or to any significant degree under some applications and in accordance with those skilled in the art. Moreover, "formed on" can also mean "formed over." The term "connected" can include an electrical connection.

FIG. 1 is a block diagram illustrating a pixel circuit according to an example embodiment. Depending on embodiments, certain elements may be removed from or additional elements may be added to the pixel circuit 100 illustrated in FIG. 1. Furthermore, two or more elements may be combined into a single element, or a single element may be realized as multiple elements. This applies to the remaining apparatus embodiments.

Referring to FIG. 1, a pixel circuit 100 includes an OLED 1A, a driver 110, an initialization controller 120, and an initializer 130.

The OLED 1A has a terminal connected to a first node N1A and the other terminal receiving a ground voltage VSS. The driver 110 includes a scan transistor T1A, a driving transistor T2A and a first capacitor C1A. A drain terminal of the scan transistor T1A receives the data signal DS1, a gate terminal of the scan transistor T1A receives the scan signal SCAN1, and a source terminal of the scan transistor T1A is connected to the second node N2A. A terminal of the first capacitor C1A is connected to a gate terminal of the driving transistor T2A through a second node N2A. The other terminal of the first capacitor C1A receives a supply voltage VDD. A drain terminal of the driving transistor T2A receives the supply voltage VDD. A source terminal of the driving transistor T2A is connected to the first node N1A. The initialization controller 120 drives a third node N3A as the supply voltage VDD during a first period in which a voltage of the second node N2A becomes the ground voltage VSS. The initialization controller 120 drives the third node N3A as a sensing signal SENSE1 during a second period in which the voltage of the second node N2A becomes the supply voltage VDD. The initializer 130 drives the first node N1A as a first voltage V1 when a voltage of the third node N3A is the ground voltage VSS. The sensing signal SENSE1 is provided by a sensing signal generator.

The initialization controller 120 can include a control transistor T3A and a second capacitor C2A. A drain terminal of the control transistor T3A can receive the supply voltage VDD, a gate terminal of the control transistor T3A can be connected to the second node N2A, and a source terminal of the control transistor T3A can be connected to the third node N3A. A terminal of the second capacitor C2A can receive the sensing signal SENSE1, and the other terminal of the second capacitor C2A can be connected to the third node N3A.

The initializer 130 can include an initialization transistor T4A. A drain terminal of the initialization transistor T4A can be connected to the first node N1A, a gate terminal of the initialization transistor T4A can be connected to the third node N3A, and a source terminal of the initialization transistor T4A can receive the first voltage V1.

When the test mode signal TMS is deactivated, the pixel circuit 100 operates in the normal mode, the data signal DS1 can be provided through a first signal line DL1, and an initialization voltage generator RVGA can provide the ground voltage VSS to the initializer 130 as the first voltage V1 through a second line SL1.

When the test mode signal TMS is activated, the pixel circuit 100 operates in the test mode, the data signal DS1 having the supply voltage VSS can be provided through the first signal line DL1, a tester TESTER A can provide a test voltage as the first voltage V1 through a second signal line SL1, and the tester TESTER A can measure characteristics of the OLED 1A based on a test current TC flowing from the tester TERSTER A to the initializer 130. A characteristic of the OLED 1A can include luminance, OLED current, etc.

Figure 2:
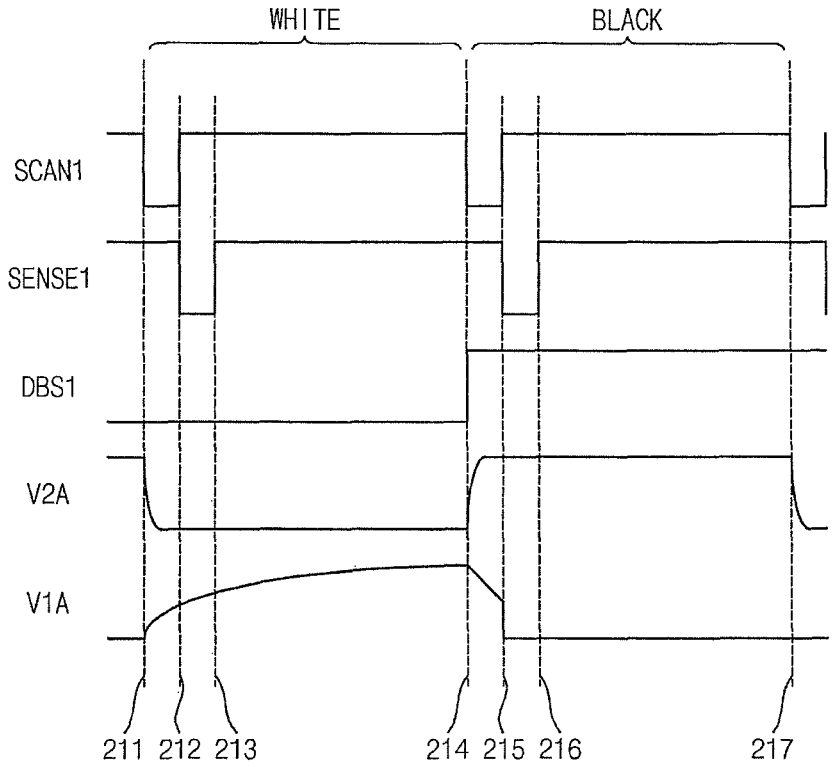
FIGS. 2 and 3 are timing diagrams illustrating operations of the pixel circuit of FIG. 1.
Figure 3:
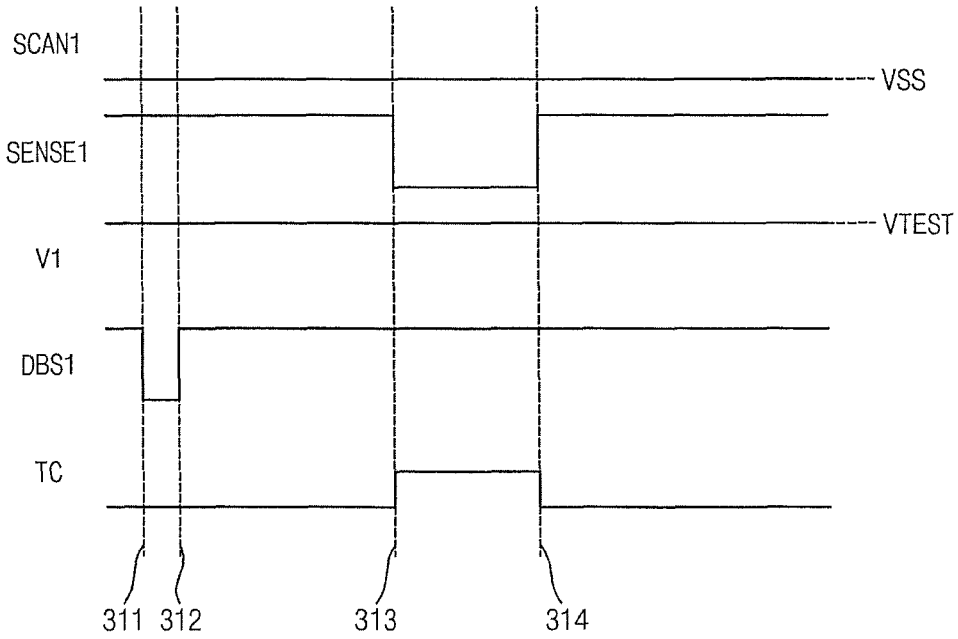

FIGS. 2 and 3 are timing diagrams illustrating operations of the pixel circuit of FIG. 1.

FIG. 2 shows a case where the pixel circuit 100 operates in the normal mode. Referring to FIGS. 1 and 2, the first and second periods WHITE are included in first sub frame periods in which the OLED 1A emits light among a plurality of sub frame periods assigned to the pixel circuit 100. The third and fourth periods BLACK can be included in second sub frame periods in which the OLED 1A does not emit light among the sub frame periods assigned to the pixel circuit 100.

During a first period 211~212, the ground voltage VSS is provided as the scan signal SCAN1, the scan transistor T1A is turned on, the ground voltage VSS is provided as the data signal DBS1, and the first capacitor C1A is charged until the voltage V2A of the second node N2A becomes the supply voltage VSS.

A second period (or first change period) 212~214 includes a first initialization period 212~213 and a first driving period 213~214. The scan signal SCAN1 has the supply voltage VDD in the second period 212~214. The sensing signal SENSE1 is activated in the first initialization period 212~213 and the sensing signal SENSE1 is deactivated in the first driving period 213~214. The data signal DBS1 has the ground voltage VSS in the second period 212~214.

In the first initialization period 212~213 and the first driving period 213~214, because the voltage V2A of the second node N2A has the ground voltage VSS, the driving transistor T2A and the control transistor T3A are turned on, the third node N3A is driven as the supply voltage VDD, the initialization transistor T4A is turned off, and the OLED 1A emits light. Because the OLED 1A includes parasitic capacitance, the voltage V1A of the first node N1A increases slowly during the second period 212~214 with a large RC constant.

During a third period 214~215, the ground voltage VSS is provided as the scan signal SCAN1, the supply voltage VDD is provided as the data signal DBS1, and the first capacitor C1A is discharged until the voltage V2A of the second node N2A becomes the supply voltage VDD.

A fourth period (or second change period) 215~217 includes a second initialization period 215~216 and a second driving period 216~217. The scan signal SCAN1 has the supply voltage VDD in the fourth period 215~217. The sensing signal SENSE1 is activated in the second initialization period 215~216 and the sensing signal SENSE1 is deactivated in the second driving period 216~217. The data signal DBS1 has the supply voltage VDD in the fourth period 215~217.

Because the voltage V2A of the second node N2A has the supply voltage VDD in the second initialization period 215~216, the driving transistor T2A and the control transistor T3A are turned off. Also, the third node N3A is driven as the ground voltage VSS, which is a voltage level of the sensing signal SENSE1, the initialization transistor T4A is turned on, and the voltage V1A of the first node N1A becomes the ground voltage VSS. Electric charges of the OLED 1A can be discharged through the initialization transistor T4A during the second initialization period 215~216. For example, an after-image is removed and the gradation expression ability of the pixel circuit 100 is enhanced.

Because the voltage V2A of the second node N2A has the supply voltage VDD in the second driving period 216~217, the driving transistor T2A and the control transistor T3A are turned off, the third node N3A is driven as the supply voltage VDD, which is a voltage level of the sensing signal SENSE1, the initialization transistor T4A is turned off, and the OLED 1A does not emit light.

FIG. 3 shows a case where the pixel circuit 100 operates in a test mode.

The scan signal SCAN1 has the ground voltage VSS. The tester TESTER A provides a test voltage VTEST as the first voltage V1 through the second signal line SL2. The scan transistor T1A is turned on.

The third node N3A is floated in the first period 311~312.

Because the sensing signal SENSE1 is activated, the initialization transistor T4A is turned on, and the data signal DBS1 has the supply voltage VDD in the second period 313~314, the driving transistor T2A and the control transistor T3A are turned off. The third node N3A is driven as the ground voltage VSS, which is a voltage level of the sensing signal SENSE1. The tester TESTER A can measure the characteristic of the OLED 1A based on the test current TC flowing from the tester TESTER A to the initializer 130.

In this case, because gate voltages of the scan transistor T1A and the driving transistor T2A are fixed to the ground voltage VSS, a leakage current does not occur. Therefore, the tester TESTER A can measure the characteristic of the OLED 1A more accurately.

Figure 4:
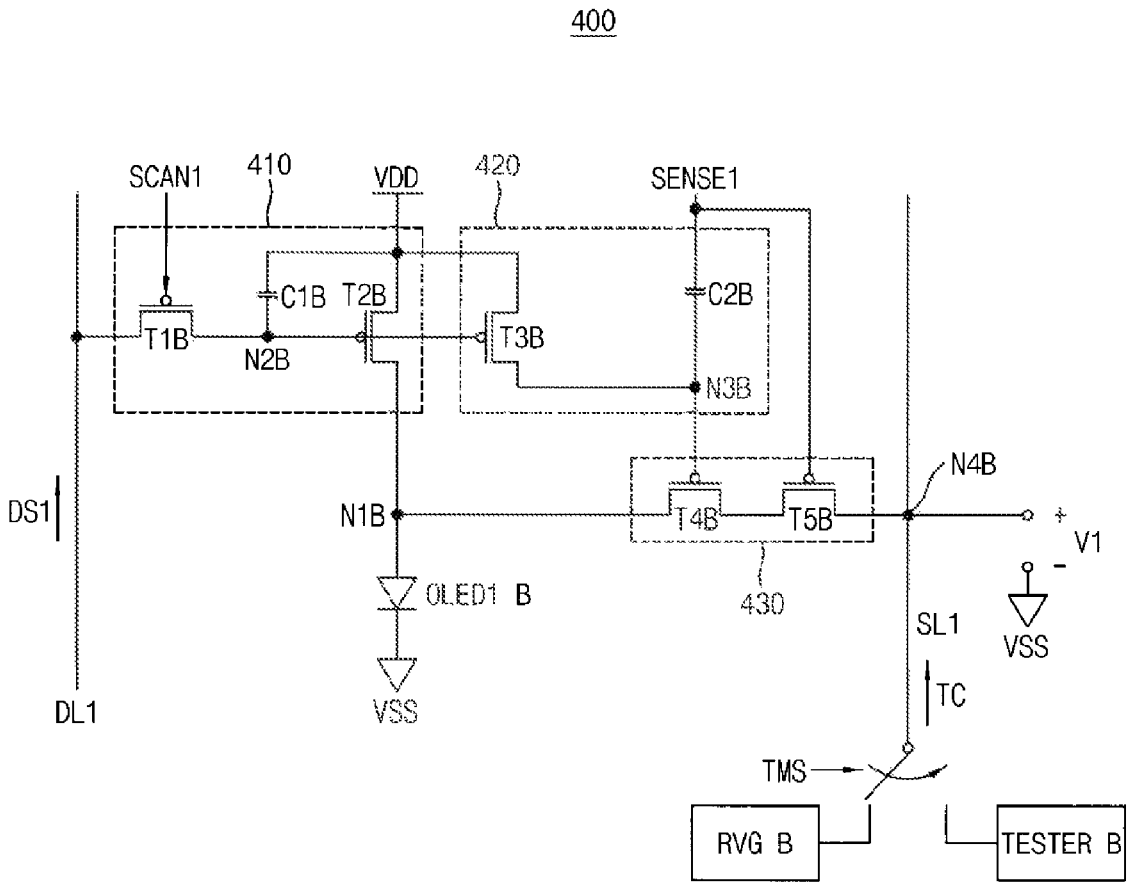
FIG. 4 is a block diagram illustrating a pixel circuit according to another example embodiment.

FIG. 4 is a block diagram illustrating a pixel circuit according to another example embodiment.

Referring to FIG. 4, a pixel circuit 400 includes an OLED 1B, a driver 410, an initialization controller 420, and an initializer 430.

The OLED 1B has a terminal connected to a first node N1B and the other terminal receiving a ground voltage VSS. The driver 410 includes a scan transistor T1B, a driving transistor T2B and a first capacitor C1B. A drain terminal of the scan transistor T1B receives the data signal DS1, a gate terminal of the scan transistor T1B receives the scan signal SCAN1, and a source terminal of the scan transistor T1B is connected to the second node N2B. A terminal of the first capacitor C1B is connected to a gate terminal of the driving transistor T2B through a second node N2B. The other terminal of the first capacitor C1B receives a supply voltage VDD. A drain terminal of the driving transistor T2B receives the supply voltage VDD. A source terminal of the driving transistor T2B is connected to the first node N1B. The initialization controller 420 drives a third node N3B as the supply voltage VDD during a first period in which a voltage of the second node N2B becomes the ground voltage VSS. The initialization controller 420 drives the third node N3B as a sensing signal SENSE1 during a second period in which the voltage of the second node N2B becomes the supply voltage VDD. The initializer 430 drives the first node N1B as a first voltage V1 when a voltage of the third node N3B is the ground voltage VSS.

The initialization controller 420 can include a control transistor T3B and a second capacitor C2B. A drain terminal of the control transistor T3B can receive the supply voltage VDD, a gate terminal of the control transistor T3B can be connected to the second node N2B, and a source terminal of the control transistor T3B can be connected to the third node N3B. A terminal of the second capacitor C2B can receive the sensing signal SENSE1, and the other terminal of the second capacitor C2B can be connected to the third node N3B.

The initializer 430 can include a first initialization transistor T4B and a second initialization transistor TSB. A drain terminal of the first initialization transistor T4B can be connected to the first node N1B, a gate terminal of the first initialization transistor T4B can be connected to the third node N3B, and a source terminal of the first initialization transistor T4B can be connected to a drain terminal of the second initialization transistor T5B. A gate terminal of the second initialization transistor T5B can receive the sensing signal SENSE1, and a source terminal of the second initialization transistor T5B can receive the first voltage V1.

When the test mode signal TMS is deactivated, the pixel circuit 400 operates in the normal mode, the data signal DS1 can be provided through a first signal line DL1, and an initialization voltage generator RVGB can provide the ground voltage VSS to the initializer 430 as the first voltage V1 through a second line SL1.

When the test mode signal TMS is activated, the pixel circuit 400 operates in the test mode, the data signal DS1 having the supply voltage VSS can be provided through the first signal line DL1, a tester TESTER B can provide a test voltage as the first voltage V1 through a second signal line SL1, and the tester TESTER B can measure characteristic of the OLED 1B based on a test current TC flowing from the tester TERSTER B to the initializer 430.

When the first initialization transistor T4B operates incorrectly because the voltage of the third node N3B is not stable, the second initialization transistor T5B can prevent unintended initialization of the OLED 1B by separating the first node N1B and the fourth node N4B electrically in response to the activated sensing signal SENSE1.

Remaining structure and operation of the pixel circuit 400 can be understood based on the references to FIGS. 1 through 3.

Figure 5:
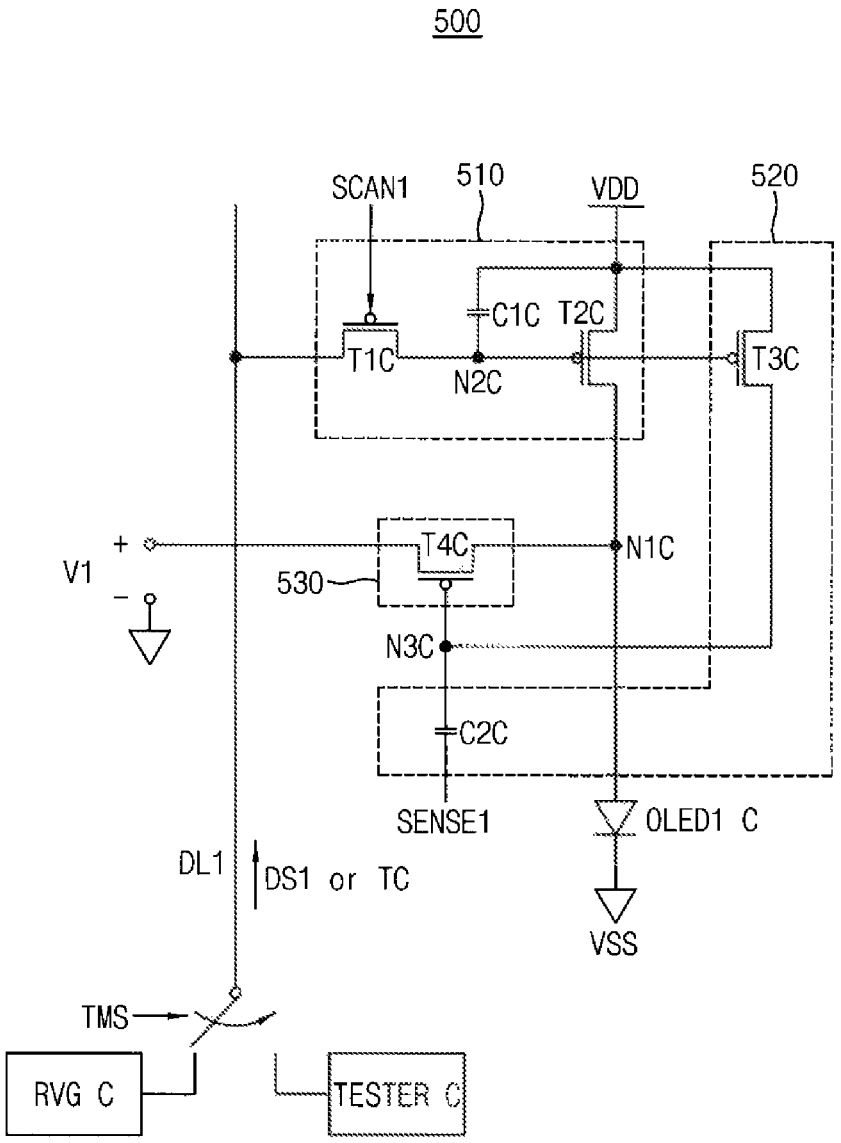
FIG. 5 is a block diagram illustrating a pixel circuit according to still another example embodiment.

FIG. 5 is a block diagram illustrating a pixel circuit according to still another example embodiment.

Referring to FIG. 5, a pixel circuit 500 includes an OLED 1C, a driver 510, an initialization controller 520, and an initializer 530.

The OLED 1C has a terminal connected to a first node N1C and the other terminal receiving a ground voltage VSS. The driver 510 includes a scan transistor TIC, a driving transistor T2C and a first capacitor C1C. A drain terminal of the scan transistor T1C receives the data signal DS1, a gate terminal of the scan transistor T1C receives the scan signal SCAN1, and a source terminal of the scan transistor T1C is connected to the second node N2C. A terminal of the first capacitor C1C is connected to a gate terminal of the driving transistor T2C through a second node N2C. The other terminal of the first capacitor C1C receives a supply voltage VDD. A drain terminal of the driving transistor T2C receives the supply voltage VDD. A source terminal of the driving transistor T2C is connected to the first node N1C. The initialization controller 520 drives a third node N3C as the supply voltage VDD during a first period in which a voltage of the second node N2C becomes the ground voltage VSS. The initialization controller 520 drives the third node N3C as a sensing signal SENSE1 during a second period in which the voltage of the second node N2C becomes the supply voltage VDD. The initializer 530 drives the first node N1C as a first voltage V1 when a voltage of the third node N3C is the ground voltage VSS.

The initialization controller 520 can include a control transistor T3C and a second capacitor C2C. A drain terminal of the control transistor T3C can receive the supply voltage VDD, a gate terminal of the control transistor T3C can be connected to the second node N2C, and a source terminal of the control transistor T3C can be connected to the third node N3C. A terminal of the second capacitor C2C can receive the sensing signal SENSE1, and the other terminal of the second capacitor C2C can be connected to the third node N3C.

The initializer 530 can include an initialization transistor T4C. A drain terminal of the initialization transistor T4C can be connected to the first node N1C, a gate terminal of the initialization transistor T4C can be connected to the third node N3C, and a source terminal of the initialization transistor T4C can receive the first voltage V1.

Figure 6:
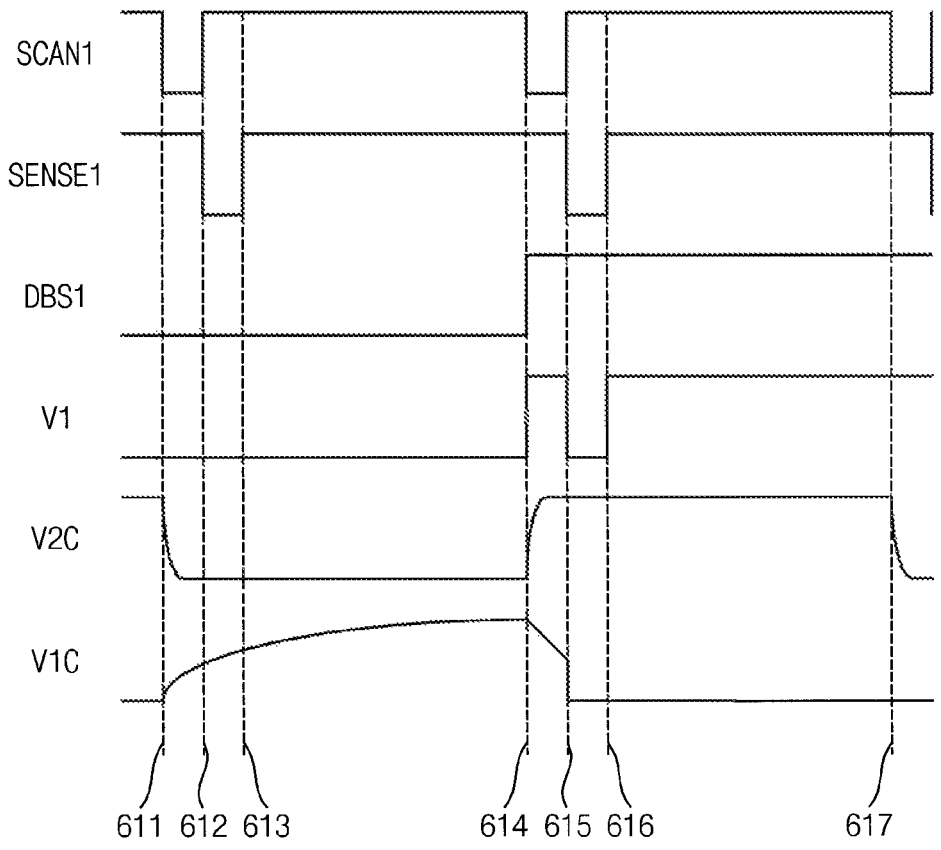
FIG. 6 is a timing diagram illustrating operation of the pixel circuit of FIG. 5.

FIG. 6 is a timing diagram illustrating operation of the pixel circuit of FIG. 5. FIG. 6 shows a case where the pixel circuit 500 of FIG. 5 operates in the normal mode.

The initialization voltage generator RVGC can provide the ground voltage VSS as the first voltage V1 through a first signal line DL1 during a first initialization period 611~612 and a second initialization period 614~615. The data signal DBS1 can be provided to the first signal line DL1 during other period than the first and second initialization periods 611~612, 614~615.

During the first period 611~612, the ground voltage VSS is provided as the scan signal SCAN1, the scan transistor T1C is turned on, the ground voltage VSS is provided as the data signal DBS1, and the first capacitor C1C is charged until the voltage V2C of the second node N2C becomes the supply voltage VSS.

A second period 612~614 includes a first initialization period 612~613 and a first driving period 613~614. The scan signal SCAN1 has the supply voltage VDD in the second period 612~614. The sensing signal SENSE1 is activated in the first initialization period 612~613 and the sensing signal SENSE1 is deactivated in the first driving period 613~614. The data signal DBS1 and the first voltage V1 has the ground voltage VSS in the second period 612~614.

In the first initialization period 612~613 and the first driving period 613~614, because the voltage V2C of the second node N2C has the ground voltage VSS, the driving transistor T2C and the control transistor T3C are turned on, the third node N3C is driven as the supply voltage VDD, the initialization transistor T4C is turned off, and the OLED 1C emits light. Because the OLED 1C includes parasitic capacitance, the voltage V1C of the first node N1C increases slowly in the second period 612~614 with a large RC constant.

During a third period 614~615, the ground voltage VSS is provided as the scan signal SCAN1, the supply voltage VDD is provided as the data signal DBS1, and the first capacitor C1C is discharged until the voltage V2C of the second node N2C becomes the supply voltage VDD.

A fourth period 615~617 includes a second initialization period 615~616 and a second driving period 616~617. The scan signal SCAN1 has the supply voltage VDD in the fourth period 615~617. The sensing signal SENSE1 is activated in the second initialization period 615~616 and the sensing signal SENSE1 is deactivated in the second driving period 616~617. The data signal DBS1 has the supply voltage VDD in the fourth period 615~617.

Because the voltage V2C of the second node N2C has the supply voltage VDD in the second initialization period 615~616, the driving transistor T2C and the control transistor T3C are turned off, the third node N3C is driven as the ground voltage VSS, which is a voltage level of the sensing signal SENSE1, the initialization transistor T4C is turned on, and the voltage V1C of the first node N1C becomes the ground voltage VSS, which is provided as the first voltage V1 to the first signal line DL1 by the initialization voltage generator RVGC. Electric charges of the OLED 1C can be discharged through the initialization transistor T4C during the second initialization period 615~616. For example, an after-image is removed and the gradation expression ability of the pixel circuit 500 is enhanced.

Because the voltage V2C of the second node N2C has the supply voltage VDD in the second driving period 616~617, the driving transistor T2C and the control transistor T3C are turned off, the third node N3C is driven as the supply voltage VDD, which is a voltage level of the sensing signal SENSE1, the initialization transistor T4C is turned off, and the OLED 1C does not emit light.

The case where the pixel circuit 500 of FIG. 5 operates in the test mode can be understood based on the reference to FIG. 3.

Figure 7:
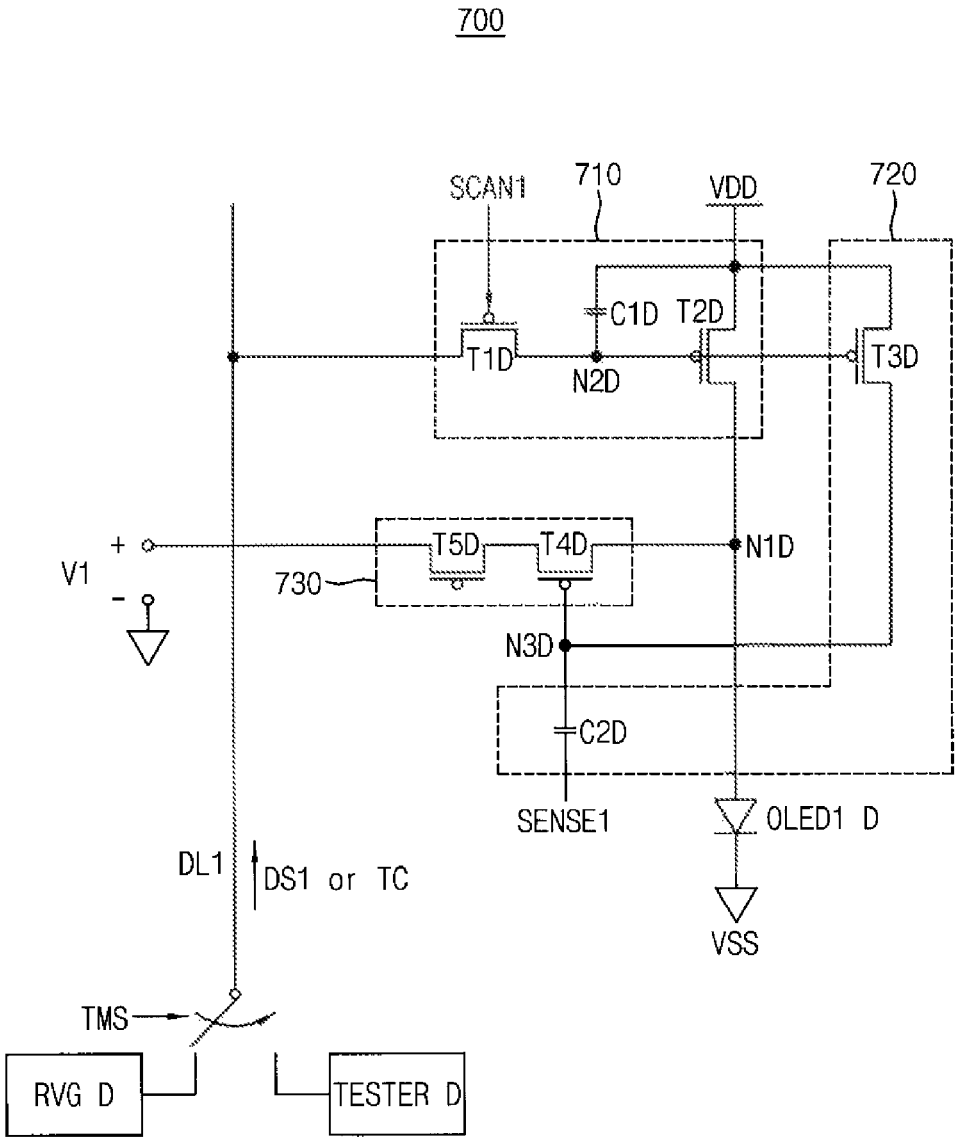
FIG. 7 is a block diagram illustrating a pixel circuit according to still another example embodiment.

FIG. 7 is a block diagram illustrating a pixel circuit according to still another example embodiment.

The pixel circuit 700 of FIG. 7 can be understood based on the description about the pixel circuit 400 of FIG. 4 and the pixel circuit 500 of FIG. 5. The pixel circuit 700 includes a driver 710, an initialization controller 720, an initializer 730, and OLED 1D. The driver 710, initialization controller 720, initializer 730 and OLED 1D are respectively similar to the driver 110, the initialization controller 120, and the initialization 130, and OLED 1A of FIG. 1 above. Furthermore, initialization voltage generator RVGD and tester TESTER D are similar to the initialization voltage generator RVG A and the tester TESTER A.

Figure 8:
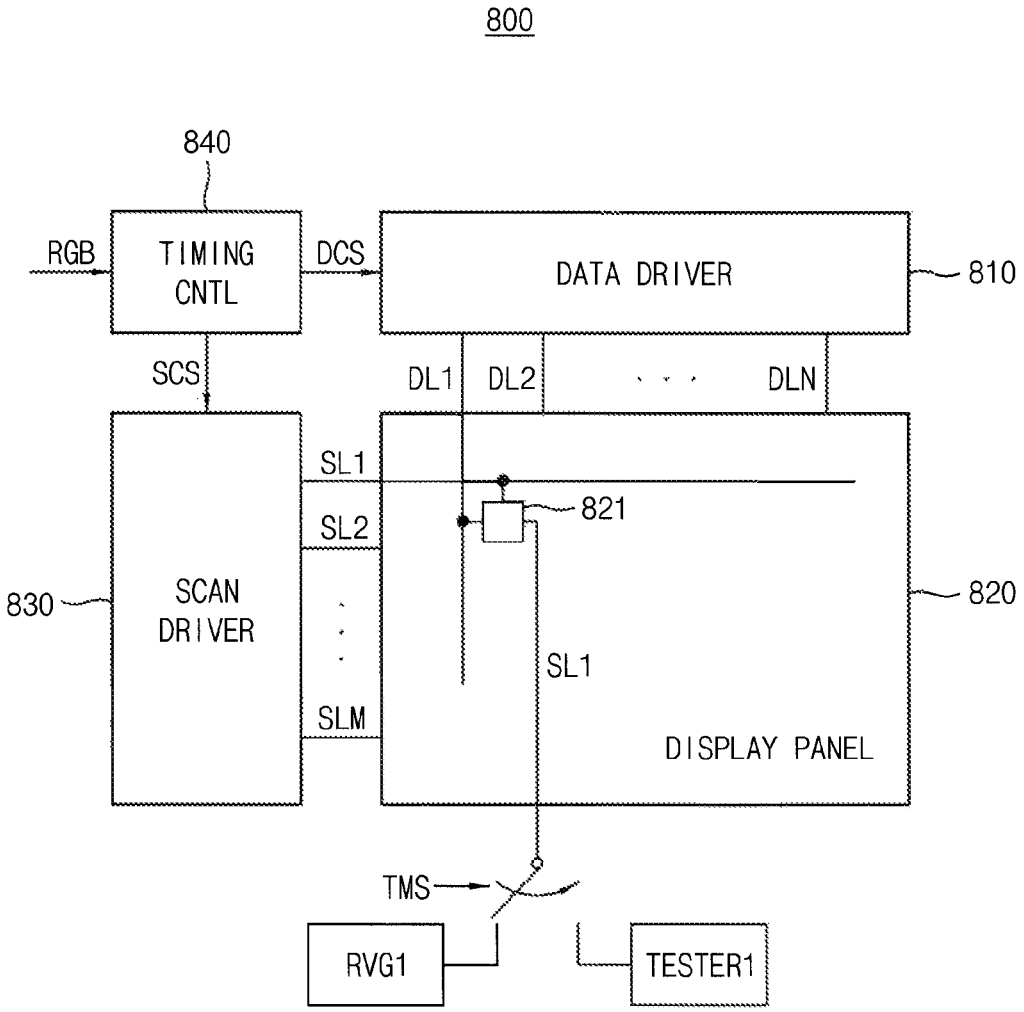
FIGS. 8 and 9 are block diagrams illustrating display devices according to example embodiments.
Figure 9:
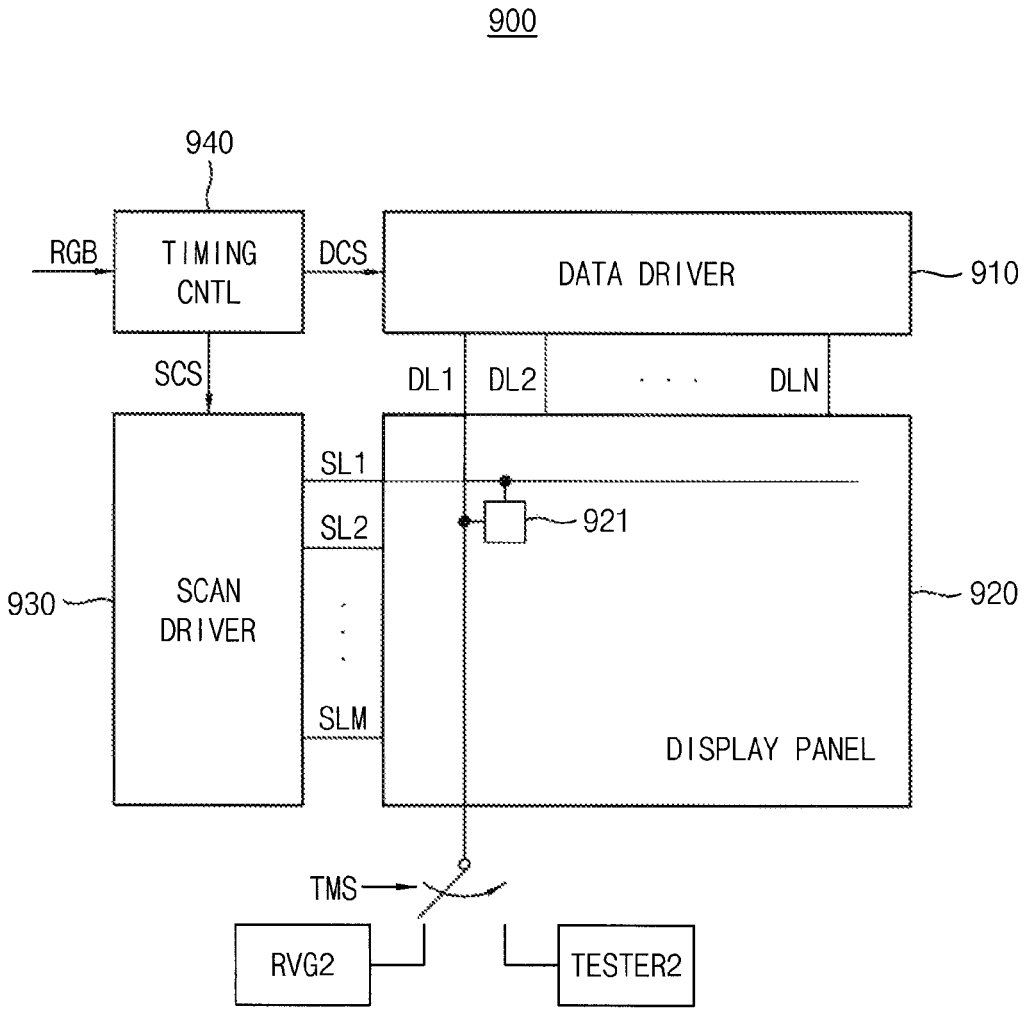

FIGS. 8 and 9 are block diagrams illustrating display devices according to example embodiments.

Referring to FIG. 8, a display device 800 includes a timing controller 840, a display panel 820, a data driver 810, and a scan driver 830.

The timing controller 840 generates a data driver control signal DCS and a scan driver control signal SCS based on a pixel data RGB. The display panel 820 includes a plurality of pixel circuits 821. The data driver 810 generates a plurality of data signals based on the data driver control signal DCS, and provides the data signals to the pixel circuits 821 through a plurality of data signal lines DL1, DL2 through DLN. The scan driver 830 generates a plurality of scan signals based on the scan driver control signal SCS, and provides the scan signals to the pixel circuits 821 through a plurality of scan signal lines SL1, SL2 through SLM.

Each of the pixel circuits 821 can be embodied with the pixel circuit 100 of FIG. 1 or the pixel circuit 400 of FIG. 4.

Referring to FIG. 9, each of a plurality of pixel circuits 921 included in the display device 900 is similar to the pixel circuit 500 of FIG. 5 or the pixel circuit 700 of FIG. 7. The display device 900 can have the same or similar structure with the display device 800 of FIG. 8.

Figure 10:
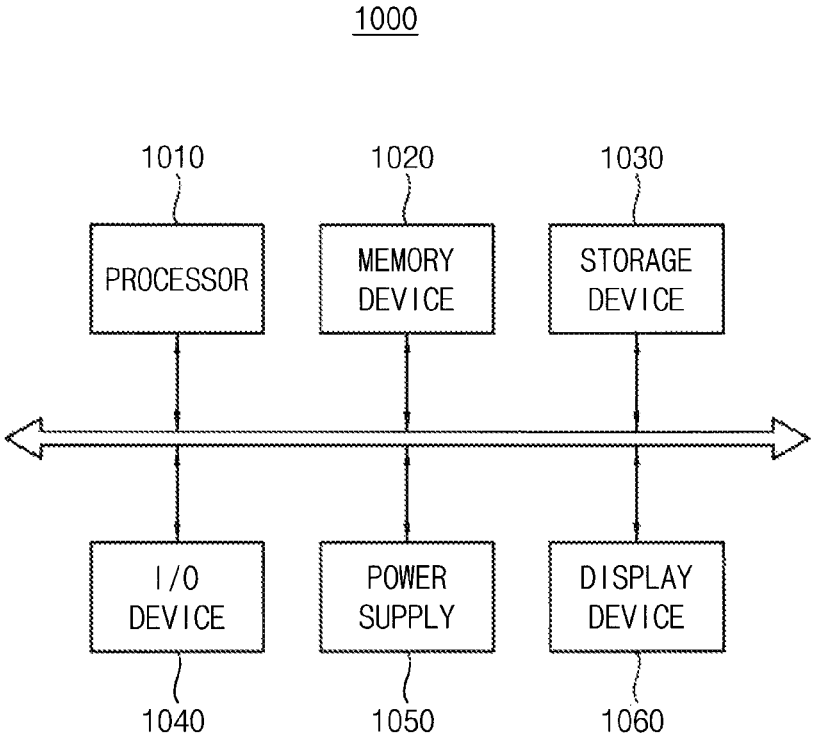
FIG. 10 is a block diagram illustrating electronic device including display device according to an example embodiment.

FIG. 10 is a block diagram illustrating electronic device including display device according to an example embodiment.

Referring to FIG. 10, an electronic device 1000 includes a processor 1010, a memory device 1020, a storage device 1030, an input/output (I/O) device 1040, a power supply 1050, and a display device 1060. Here, the electronic device 1000 can further include a plurality of ports for communicating with a video card, a sound card, a memory card, a universal serial bus (USB) device, other electronic devices, etc. Although the electronic device 1000 is implemented as a smartphone, a kind of the electronic device 1000 is not limited thereto.

The processor 1010 can perform various computing functions. The processor 1010 can be a microprocessor, a central processing unit (CPU), etc. The processor 1010 can be coupled to other components via an address bus, a control bus, a data bus, etc. Further, the processor 1010 can be coupled to an extended bus such as a peripheral component interconnection (PCI) bus.

The memory device 1020 can store data for operations of the electronic device 1000. For example, the memory device 1020 includes at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile DRAM device, etc.

The storage device 1030 can be a solid state drive (SSD) device, a hard disk drive (HDD) device, a CD-ROM device, etc. The I/O device 1040 can be an input device such as a keyboard, a keypad, a touchpad, a touch-screen, a mouse, etc., and an output device such as a printer, a speaker, etc. The power supply 1050 can provide a power for operations of the electronic device 1000. The display device 1060 can communicate with other components via the buses or other communication links.

The display device 1060 can be the display device 800 of FIG. 8 or the display device 900 of FIG. 9. The display device 1060 can be understood based on the references to FIGS. 1 through 9.

The example embodiments can be applied to any electronic system 1000 having the display device 1060. For example, the present embodiments are applied to the electronic system 1000, such as digital or 3D televisions, computer monitors, home appliances, laptop computers, digital cameras, cellular phones, smartphones, personal digital assistants (PDAs), portable multimedia players (PMPs), MP3 players, portable game consoles, navigation systems, video phones, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the inventive technology. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A pixel circuit of an display device, the pixel circuit comprising:

an organic light-emitting diode (OLED) including a first terminal electrically connected to a first node and a second terminal electrically connected to a ground voltage;

a driver including i) a driving transistor including gate, drain and source terminals and ii) a first capacitor configured to be charged based on a scan signal and a data signal, wherein the first capacitor includes i) a first terminal electrically connected to the gate terminal of the driving transistor via a second node and ii) a second terminal directly connected to a supply voltage, wherein the drain terminal of the driving transistor is electrically connected to the supply voltage, and wherein the source terminal of the driving transistor is electrically connected to the first node;

an initialization controller configured to i) provide the supply voltage to a third node during a first change period in which the initialization controller is further configured to provide the ground voltage to the second node and ii) provide a sensing signal to the third node during a second change period in which the initialization controller is further configured to provide the supply voltage to the second node; and an initializer configured to provide a first voltage to the first node when a voltage of the third node is the ground voltage, wherein the initialization controller includes:

a control transistor including a drain terminal electrically connected to the supply voltage, a gate terminal electrically connected to the second node, and a source terminal electrically connected to the third node; and a second capacitor including a first terminal configured to receive the sensing signal from a sensing signal generator and a second terminal electrically connected to the third node.

2. The pixel circuit of claim 1, wherein the first change period includes a first initialization period and a first driving period following the first initialization period, wherein the second change period includes a second initialization period and a second driving period following the second initialization period, wherein the initialization controller is further configured to i) receive the sensing signal having a first voltage level during the first initialization period, ii) receive the sensing signal having a second voltage level during the first driving period, iii) receive the sensing signal having the first voltage level during the second initialization period, and iv) receive the sensing signal having the second voltage level during the second driving period, in response to the pixel circuit operating in a normal mode, wherein the first and second voltage levels are different, wherein the driver is configured to receive the data signal via a first signal line, and wherein the initializer is configured to receive the ground voltage as the first voltage from an initialization voltage generator via a second signal line.

3. The pixel circuit of claim 2, wherein the OLED is configured to emit light during a plurality of first sub frame periods and not emit light during a plurality of second sub frame periods, and wherein each first sub frame period includes the first change period and wherein each second sub frame period includes the second change period.

4. The pixel circuit of claim 2, wherein the driver is further configured to i) receive the ground voltage as the data signal during a third period preceding the first change period and ii) receive the ground voltage as the scan signal during the third period so as to charge the first capacitor.

5. The pixel circuit of claim 2, wherein, during the first change period, the driving transistor is configured to be turned on and the OLED is configured to emit light.

6. The pixel circuit of claim 2, wherein the driver is further configured to i) receive the supply voltage as the data signal during a fourth period preceding the second change period and ii) receive the ground voltage as the scan signal during the fourth period so as to discharge the first capacitor.

7. The pixel circuit of claim 2, wherein, in the second initialization period, i) the initializer is further configured to discharge electric charge of a parasitic capacitor of the OLED and ii) the driving transistor is configured to be turned off, such that the OLED does not emit light.

8. The pixel circuit of claim 1, wherein the driver is configured to i) receive the ground voltage as the scan signal and ii) receive the supply voltage as the data signal via a first signal line, in response to the pixel circuit in a test mode, wherein, during the second change period, the initialization controller is further configured to receive the sensing signal having a first voltage level, wherein the initializer is further configured to receive a test voltage as the first voltage via a second signal line and wherein a characteristic of the OLED is configured to be measured based on the test voltage.

9. The pixel circuit of claim 8, wherein the characteristic includes at least one of luminance and OLED current.

10. The pixel circuit of claim 1, wherein the first change period includes a first initialization period and a first driving period following the first initialization period, wherein the second change period includes a second initialization period and a second driving period following the second initialization period, wherein the initialization controller is further configured to i) receive the sensing signal having a first voltage during the first initialization period, ii) receive the sensing signal having a second voltage level during the first driving period, iii) receive the sensing signal having the first voltage level during the second initialization period, and iv) receive the sensing signal having the second voltage during the second driving period, wherein the first and second voltage levels are different, wherein the initializer is further configured receive the ground voltage as the first voltage via a first signal line during the first and second initialization periods, and wherein the driver is configured to receive the data signal via the first signal line during a period other than the first and second initialization periods.

11. The pixel circuit of claim 1, wherein the driver is configured to receive the ground voltage as the scan signal, in response to the pixel circuit operating in a test mode, and wherein, during the second change period, the initialization controller is further configured to receive the sensing signal having the first voltage level, wherein the initializer is further configured to receive a test voltage as the first voltage via a first signal line and wherein a characteristic of the OLED is configured to be measured based on the test voltage.

12. The pixel circuit of claim 1, wherein the driver further includes a scan transistor including i) a drain terminal configured to receive the data signal from a data line, ii) a gate terminal configured to receive the scan signal from a scan line, and iii) a source terminal electrically connected to the second node.

13. The pixel circuit of claim 1, wherein the initializer includes an initialization transistor including a drain terminal electrically connected to the first node, a gate terminal electrically connected to the third node, and a source terminal electrically connected to the first voltage.

14. The pixel circuit of claim 1, wherein the initializer includes:

a first initialization transistor including a drain terminal electrically connected to the first node, a gate terminal electrically connected to the third node, and a source terminal; and a second initialization transistor including a gate terminal configured to receive the sensing signal from a sensing signal generator, a source terminal electrically connected to the first voltage, and a drain terminal electrically connected to the source terminal of the first initialization transistor.

15. The pixel circuit of claim 1, wherein the first node is directly connected to only the driving transistor and the initializer.

16. A display device comprising:

a timing controller configured to generate a data driver control signal and a scan driver control signal based on pixel data;

a display panel including a plurality of pixel circuits;

a data driver configured to generate a plurality of data signals based on the data driver control signal and provide the data signals to the pixel circuits via a plurality of data signal lines, wherein the data signals include a first data signal; and a scan driver configured to generate a plurality of scan signals based on the scan driver control signal and provide the scan signals to the pixel circuits via a plurality of scan signal lines, wherein the scan signals include a first scan signal, wherein a selected pixel circuit among the pixel circuits includes:

an organic light-emitting diode (OLED) including a first terminal electrically connected to a first node and a second terminal electrically connected to a ground voltage;

a driver including i) a driving transistor including gate, drain and source terminals and ii) a first capacitor configured to be charged based on the first scan signal and the first data signal, wherein the first capacitor includes i) a first terminal electrically connected to the gate terminal of the driving transistor via a second node and ii) a second terminal directly connected a supply voltage, wherein the drain terminal of the driving transistor is electrically connected to the supply voltage, and wherein the source terminal of the driving transistor is electrically connected to the first node;

an initialization controller configured to i) provide the supply voltage to a third node during a first change period in which the initialization controller is further configured to provide the ground voltage to the second node and ii) provide a sensing signal to the third node during a second change period in which the initialization controller is further configured to provide the supply voltage to the second node; and an initializer configured to provide a first voltage to the first node when a voltage of the third node is the ground voltage, and wherein the initialization controller includes:

a control transistor including a drain terminal electrically connected to the supply voltage, a gate terminal electrically connected to the second node, and a source terminal electrically connected to the third node; and a second capacitor including a first terminal configured to receive the sensing signal from a sensing signal generator and a second terminal electrically connected to the third node.

17. The display device of claim 16, wherein the first change period includes a first initialization period and a first driving period following the first initialization period, wherein the second change period includes a second initialization period and a second driving period following the second initialization period, wherein the data driver is further configured to generate the first data signal via a first signal line, and wherein the display device further comprises:

a sensing signal generator is configured to i) activate the sensing signal during the first initialization period, ii) deactivate the sensing signal during the first driving period, iii) activate the sensing signal during the second initialization period, and iv) deactivate the sensing signal during the second driving period, in response to the pixel circuit operating in a normal mode, and an initialization voltage generator is configured to generate the ground voltage to the initializer as the first voltage via a second signal line.

18. The display device of claim 17, wherein the OLED is configured to emit light during a plurality of first sub frame periods and not emit light during a plurality of second sub frame periods, and wherein each first sub frame period includes the first change period and each second sub frame period includes the second change period.

19. The display device of claim 17, wherein the data driver is further configured to generate the ground voltage as the first data signal during a third period preceding the first change period, and wherein the scan driver is configured to generate the ground voltage as the first scan signal during the third period so as to charge the first capacitor.

20. The display device of claim 17, wherein the driving transistor is configured to be turned on during the first change period and wherein the OLED is configured to emit light during the first change period.

* * * * *